US007665949B2

(12) United States Patent
Pearce

(10) Patent No.: US 7,665,949 B2
(45) Date of Patent: Feb. 23, 2010

(54) CARTON HANDLING METHOD AND APPARATUS

(75) Inventor: William Laurence Pearce, Koonya (AU)

(73) Assignee: Layertech Holdings Pty Ltd, Tottenham, Victoria (AU)

( * ) Notice: Subject to any disclaimer, the term of this patent is extended or adjusted under 35 U.S.C. 154(b) by 537 days.

(21) Appl. No.: 10/990,259

(22) Filed: Nov. 15, 2004

(65) Prior Publication Data

US 2005/0095106 A1 May 5, 2005

(51) Int. Cl.
*B66F 9/14* (2006.01)
*B66F 9/18* (2006.01)

(52) U.S. Cl. ..... 414/627; 294/65; 414/797

(58) Field of Classification Search ..... 414/627, 414/797, 737; 294/65
See application file for complete search history.

(56) References Cited

U.S. PATENT DOCUMENTS 3,230,002 A * 1/1966 Olson ..... 294/64.1
3,351,370 A * 11/1967 Olson ..... 294/64.1
3,523,707 A * 8/1970 Roth ..... 294/65
3,716,147 A 2/1973 Pipes
3,724,835 A * 4/1973 Gnoth ..... 269/21
3,866,767 A 2/1975 Zollinger et al.
3,923,177 A * 12/1975 Horton ..... 414/627
4,129,223 A * 12/1978 Probst ..... 414/607
4,185,814 A * 1/1980 Buchmann et al. ..... 271/108
4,252,496 A * 2/1981 Williams ..... 414/623
4,340,661 A * 7/1982 Ono et al. ..... 430/223
4,725,186 A * 2/1988 Jerue ..... 414/627
4,787,812 A * 11/1988 Gopfert ..... 414/737
4,878,798 A 11/1989 Johansson
4,946,335 A 8/1990 King et al.
5,149,162 A 9/1992 Focke et al.
5,156,519 A * 10/1992 Johansson ..... 414/608
5,297,830 A * 3/1994 Hoke ..... 294/65
5,516,254 A 5/1996 Gessler
5,516,255 A 5/1996 Tygard
5,636,966 A 6/1997 Lyon et al.
5,755,550 A 5/1998 Brandt et al.
5,975,837 A 11/1999 Focke et al.
6,024,529 A * 2/2000 Kristensen ..... 414/607
6,039,529 A * 3/2000 Persson ..... 414/627
6,082,080 A 7/2000 Holter et al.
6,135,704 A 10/2000 Seaberg
6,802,688 B1 * 10/2004 Andersen et al. ..... 414/796.2
7,000,964 B1 * 2/2006 Porras et al. ..... 294/64.1

FOREIGN PATENT DOCUMENTS

CA 2291927 4/2001
DE 3417736 11/1985
DE 4206038 9/1993

(Continued)

*Primary Examiner*—James Keenan
(74) *Attorney, Agent, or Firm*—Sughrue Mion, PLLC

(57) ABSTRACT

An accessory for a forklift allows handling of cartoned goods a whole layer at a time and part of a layer. The head has a series of closely parked suction devices which are served by a common vacuum chamber. The head is carried by the forks and vacuum is supplied by a separate unit mounted on the forklift. In a modification, the head is carried on a sub assembly which allows the head to move to one side of the forklift.

27 Claims, 12 Drawing Sheets

FOREIGN PATENT DOCUMENTS

| | | | |
|---|---|---|---|
| EP | 0550114 | | 7/1993 |
| FR | 2514738 | | 4/1983 |
| FR | 2675493 | * | 10/1992 |
| FR | 2758316 | | 7/1998 |
| GB | 1164766 | | 9/1969 |
| GB | 2337982 | | 12/1999 |
| JP | 2-116488 | * | 5/1990 |
| JP | 3-172298 | * | 7/1991 |
| JP | 4371500 | | 12/1992 |
| JP | 6009057 | | 1/1994 |
| JP | 6-048696 | * | 2/1994 |
| WO | 95/30615 | | 11/1995 |
| WO | 96/02444 | | 2/1996 |
| WO | 00/26127 | | 5/2000 |
| WO | 00/64790 | | 11/2000 |

* cited by examiner

CARTON HANDLING METHOD AND APPARATUS

FIELD OF THE INVENTION

This invention concerns a method and apparatus for handling cartoned goods.

BACKGROUND OF THE INVENTION

Cartoned goods leave the factory on pallets and reside in a warehouse until purchased by a supermarket or distributor. They are taken from a warehouse rack by a robot selector or a forklift and are loaded onto a truck for transport to the retail premises. Thus the goods remain on pallets from the factory, through the warehouse, on the truck and into the supermarket. The pallets are standard size. 1200×1200 mm and a pallet load may consist of several superimposed layers of cartons. Supermarkets commonly order in multiples of pallet layers. Conventionally a pallet carries only one type of good, for example, a full load of buffer.

If an order from a supermarket is for two pallet layers of margarine, the margarine pallet will leave the warehouse with only two layers. The loader who supervises the composition of the road truck must use the road truck volume as best he may, but presently as much as 6t of the 35t load represents the timber of the pallets. This is uneconomic, the consequence of the carton by carton assembly of a customers order at the warehouse. Systems designers in the distribution business have, sought savings in records, ordering programs and software, but the physical handling of the cartons which compose the individual orders has remained unchanged for a period of years.

International pallets used in air freight do not correspond to the standard pallet in Australia and all goods must be transferred from one to the other. This is all done manually and the volume of work at airports and warehouses causes a correspondingly large number of injuries, such as repetitive strain injury (RSI).

The industry approach has been to use a stacker crane system which moves along shelving and extracts whole pallets of goods sometimes using vacuum heads carried by frames and other structures for guiding the motion of the vacuum head. Such a system is shown in U.S. Pat. Nos. 3,782,564 and 5,102,283. These systems are efficient for bulk transfers but not equipped for part pallet loads.

A forklift is versatile but the application of vacuum handling to forklifts is exemplified by U.S. Pat. No. 4,725,186 where onboard vacuum equipment working continuously is used to handle newsprint rolls. WO 97/13718 takes the handling design further by attaching vacuum pads to the front of a pallet-like structure which can be picked up by a standard forklift. When the forklift reverts to ordinary use, the special handling accessory can be removed and parked until it is needed again. Such special purpose equipment sold as an accessory is useful but not for the layer by layer problem which comes up when pallet loads are divided in wholesale grocery.

WO 01/30675 is more pertinent that the suction devices are able to handle a layer of cartons but the utilization of the equipment is not discussed.

SUMMARY OF THE INVENTION

The method aspect of the invention provides a method of assembling a warehouse order comprising transferring a pallet layer of cartons or part thereof as a group to or from a pallet.

Preferably the pallet size is 1200×1200 mm. One layer may correspond to 1-24 cartons. The transfer may be from a warehouse rack to a pallet. The transfer may be powered by a forklift truck equipped with a vacuum generator.

One apparatus aspect of the invention provides a pick up assembly for cartoned goods comprising:— gang lifting means capable of overlying a layer of cartoned goods; and means to apply a partial vacuum between the gang lifting means and the cartons for the purpose of lifting an entire layer and means capable of mounting the assembly on a forklift.

The lifting means may be a horizontal head of substantially the same area as a pallet with an array of suction devices projecting downwardly from the mount having ends which lie substantially in a common plane so as to contact the upper surface of the group of cartons on a pallet.

The mount may contain a vacuum chamber common to the array and the chamber may be connectable to a vacuum pump on the forklift truck.

The tubes may terminate in a resilient bellows so as to seal against the carton surface. The devices may be normally closed until the whole assembly is lowered by the forks to displace the tubes causing connection to vacuum. The tubes may ride telescopically on projections extending from the mount, the rise and fall being used to open and close a ball valve situated between the individual tube and the common chamber. This is a convenient arrangement of parts, but clearly any arrangement which will offer lost motion will be useful.

Preferably the vacuum pump is driven by its own motor so that the pump and motor may be accommodated as a unit in a box offering sound proofing.

The box may be mountable on the forklift, for example on the roof above the driver. The pump and the gang lifting means may be connected by a vacuum hose fed from a reel. The reel may take up the rise and fall motion of the fork. Thus the pick up assembly may be supplied with its own vacuum generator unit as retro fittable equipment for a standard forklift truck. As the forklifts are at a standard spacing, the flat rectangular gang lifting part is preferably provided with a pair of parallel shoes into which the forks may slide.

The pick up assembly is capable of lifting cartons made of waxed paperboard, plastic film wrapped articles and cellophane wrapped boxes. The aim is to provide a conversion kit which will offer the warehouse staff a q.d. accessory for a standard forklift. The suction devices will lift goods such as cartons of slightly differing heights because the 20 mm or so of lost motion in the telescoping action copes with minor irregularities. While a pallet size of 1200×1200 mm is a convenient size for the head, a larger size is used for airport operations. A still larger size is useful for flat articles such as glass mdf, plywood, plasterboard and other building panels, sheet metal and the like. The suction devices for larger heads are not so densely packed.

When the assembly is used on a forklift which travels up and down the aisles of a warehouse with racks on one or both sides, the assembly may be modified to allow the head to project into a rack and pick up or put down goods.

A further apparatus aspect provides a forklift truck with a pick up assembly carried in the fork position and a vacuum generator being part of the truck equipment. This may all be original equipment.

BRIEF DESCRIPTION OF THE DRAWINGS

Certain embodiments of the invention are now described with reference to the accompanying drawings, in which:—

Figure 1:
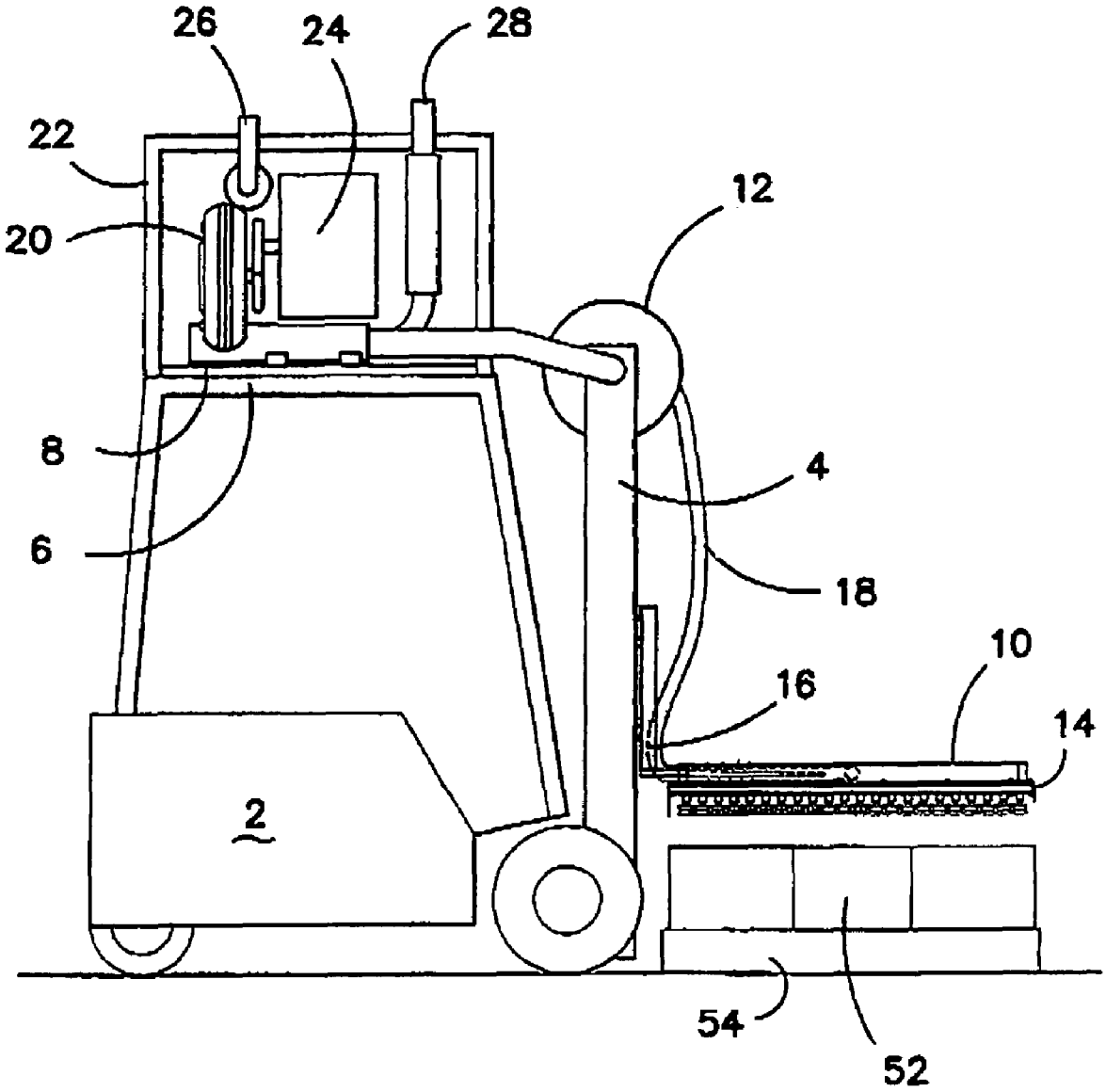
FIG. 1 is a side view of the forklift truck with the lifting assembly in position.
Figure 2:
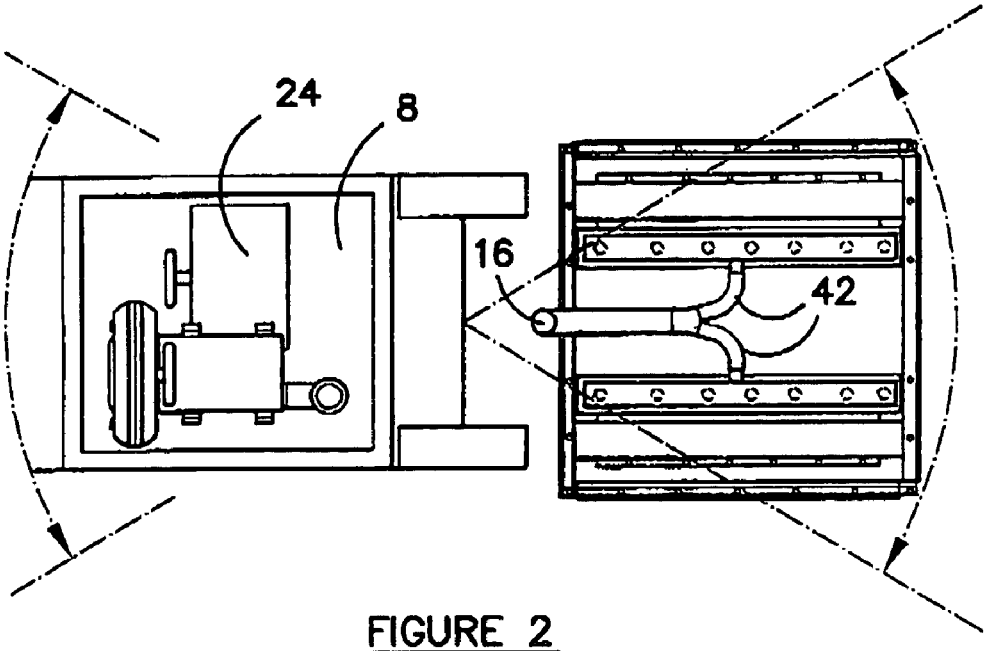
FIG. 2 is a plan of the apparatus of FIG. 1.
Figure 3:
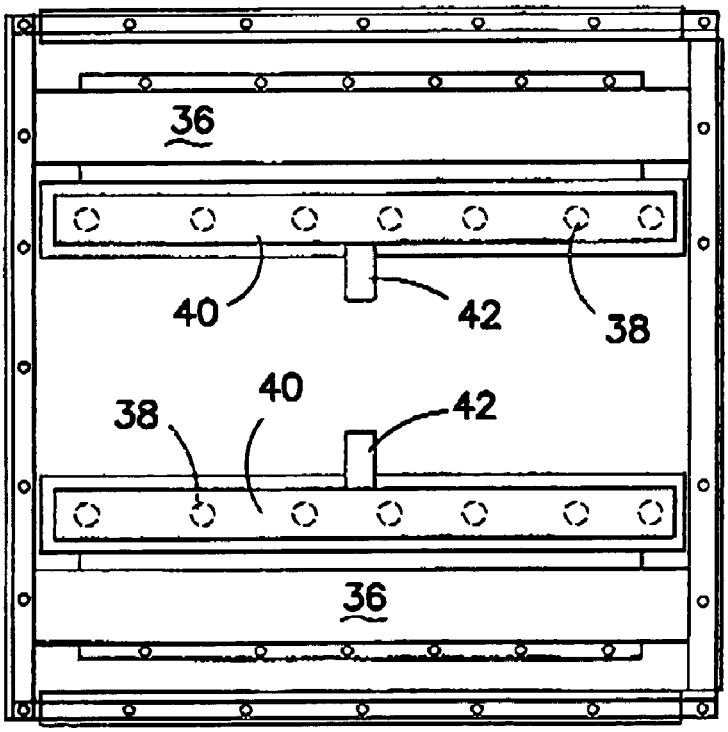
FIG. 3 is a plan of the pick up assembly.
Figure 4:
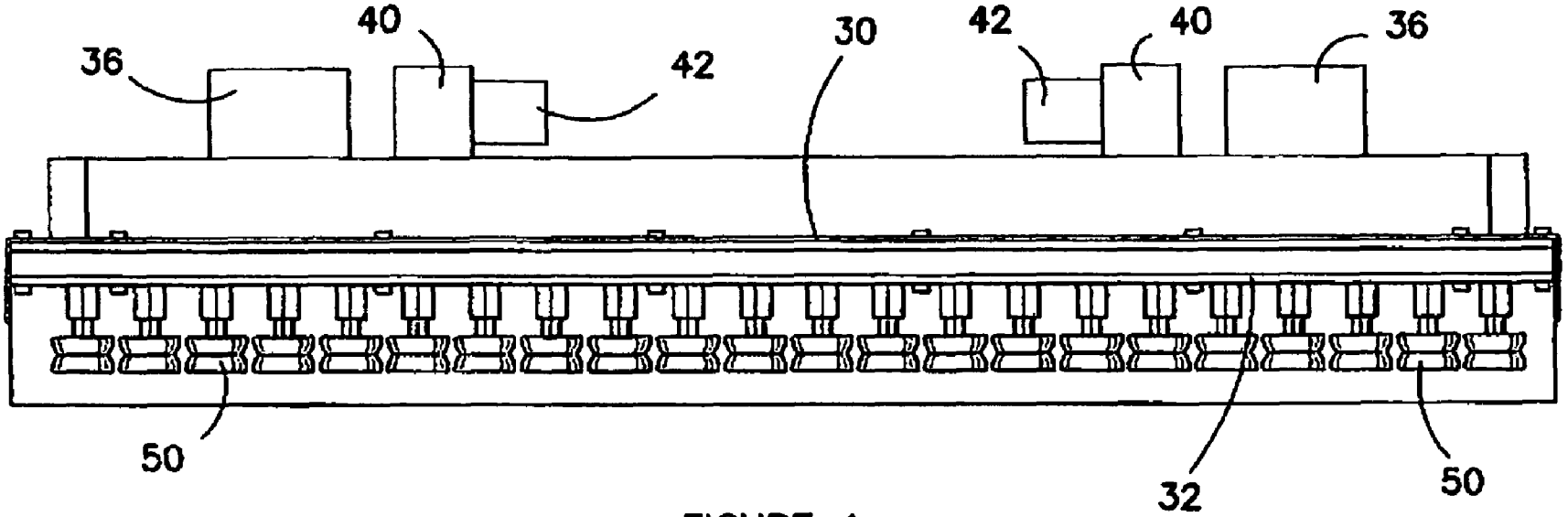
FIG. 4 is an end view of the assembly in FIG. 3.
Figure 5:
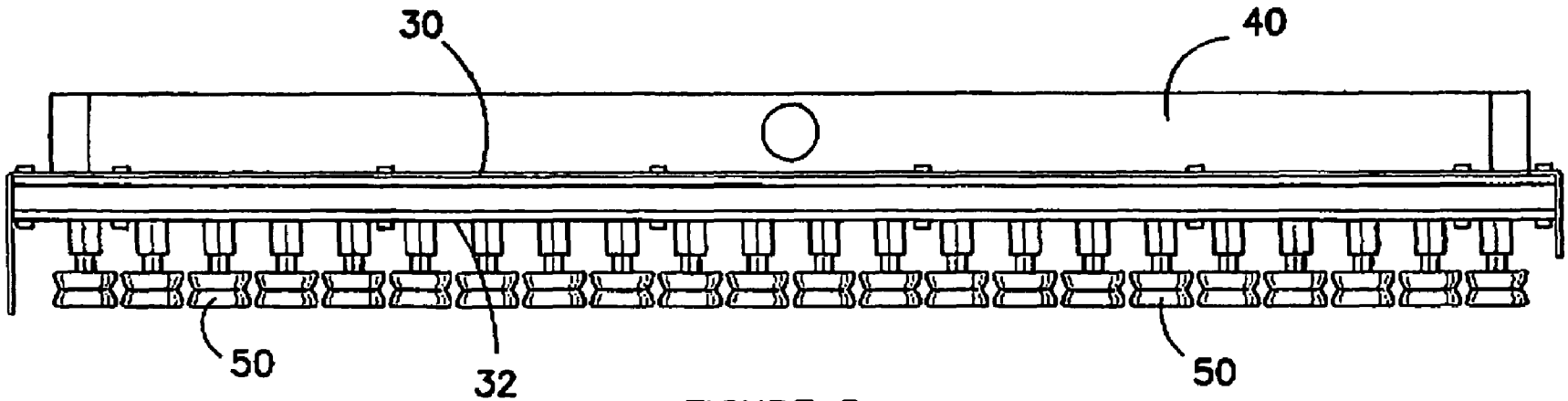
FIG. 5 is a side view of the assembly in FIG. 3.
Figure 6:
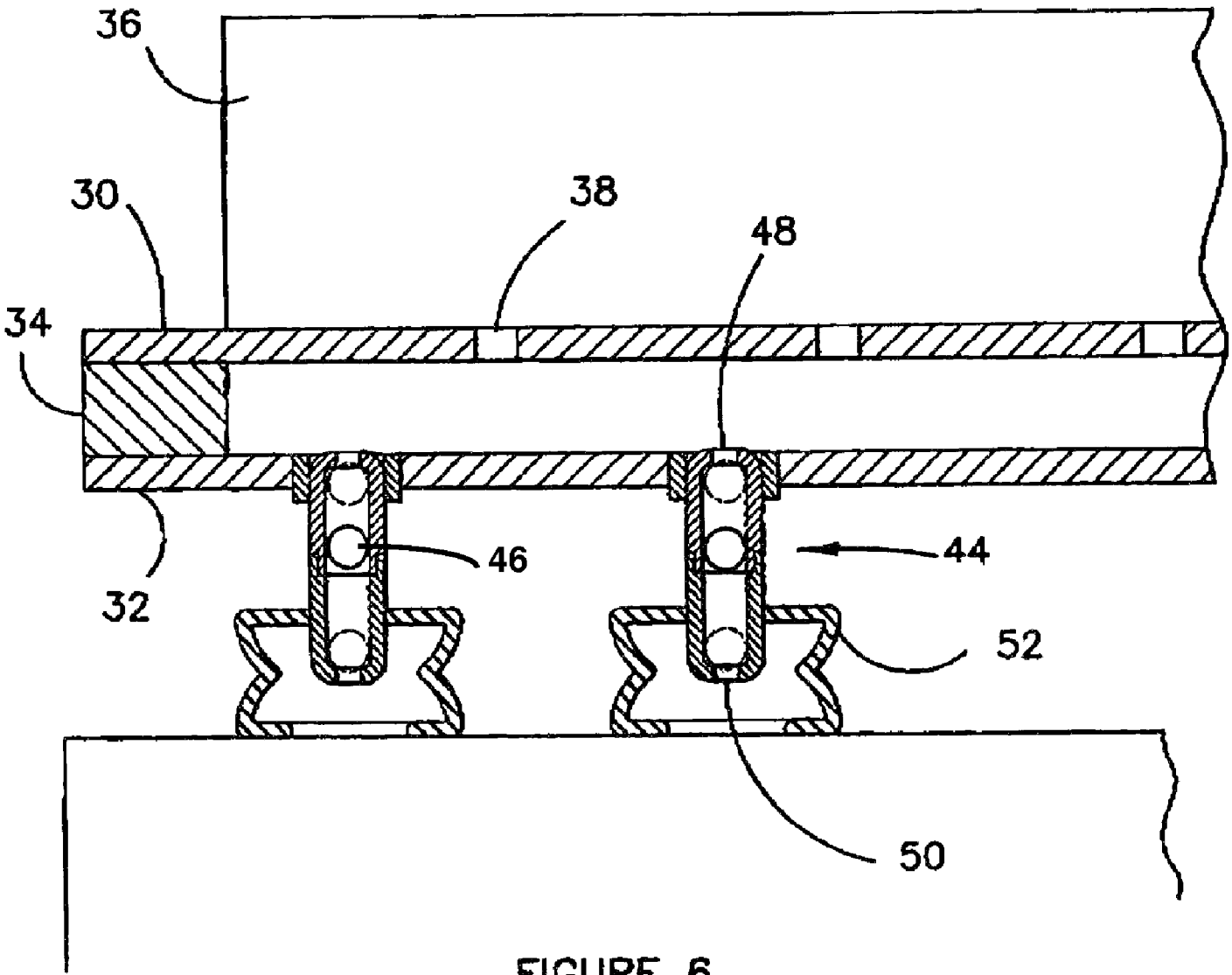
FIG. 6 is a side section of two suction devices in the pick up assembly.

All views are diagrammatic.

DETAILED DESCRIPTION WITH RESPECT TO THE DRAWINGS

Referring now to FIGS. 1-8 of the drawings, the forklift truck 2 is the type which has a mast 4 pivoted to the chassis enabling it to turn at 90° to the longitudinal axis of the truck. Bars 6 create a roof platform 8. The mast has conventional rise and fall forks 10. The top of the mast has a vacuum hose reel 12.

The 1273×1273 nm pick up assembly 14 is suspended from the forks and is connected by a self-sealing coupling 16 to the hose 18 paid out by the reel. The opposite end of the hose is connected to a vacuum generator 20 housed in a sound proof box 22 mounted on the roof platform. The vacuum pump 24 is proprietary equipment and is belt driven by a standard 24 hp LPG engine. Vacuum exhaust 26 and engine exhaust 28 discharge into the warehouse.

Pick Up Assembly

Referring now to FIGS. 2-6, a alloy top plate 30 and an alloy bottom plate 32 are bolted together at their perimeters but separated by a gasket 34. The plate 30 has a pair of longitudinal shoes 36 of top hat section. These allow the assembly to be lifted by the forks or parked when not required. The space between the plates 30, 32 is the vacuum chamber. Apertures 38 in the top plate discharge into a pair of plenums 40 alongside the shoes. The plenums 40 are emptied by ducts 42 which join and meet self-sealing coupling 16.

The bottom plate has a 23×23 array of downwardly projecting sleeves 44. Each sleeve consists of two coaxially overlapping threaded parts. The parts unscrew to admit a steel ball 46. The ball diameter is 2 mm smaller in diameter than the bore of the sleeve. The ends of the sleeve are partially closed in a hemispherical die in order to create an upper seat 48 and a lower seat 50. The lower end of the sleeve carries a rubber bellows 52 intended to contact the top of the carton 54.

The vacuum motor runs continuously but is connected intermittently to the vacuum chamber by the driver. When the operator lowers the head onto a layer of cartons and compresses the bellows about 20 mm to create a seal. When the vacuum is applied, the ball lifts off its lower seat which by gravity is its rest position. The bellows interior is quickly evacuated and a steady vacuum allows the carton to be lifted. The ball floats as air continues to flow around it into the chamber. When the motor is switched off, the vacuum collapses, gravity sends the ball down to the lower seat and the cartons are released.

In use the operator starts with an empty pallet. From his Order list he visits the rack holding cartons of fruit and transfers two layers of cartons to the waiting pallet. He next visits the racks holding cartons of laundry powder and transfers two layers to the same pallet. The pallet is full and a standard forklift removes the full pallet to a waiting road truck. If the pick up assembly is lowered onto a load which is stepped due to previous removal of part of a layer and where only some of the suction devices seal onto the load, in these unsealing devices the ball rises to the top seat and prevents air flow into the vacuum chamber until then motor is switched off.

Sub Assembly

Figure 7:
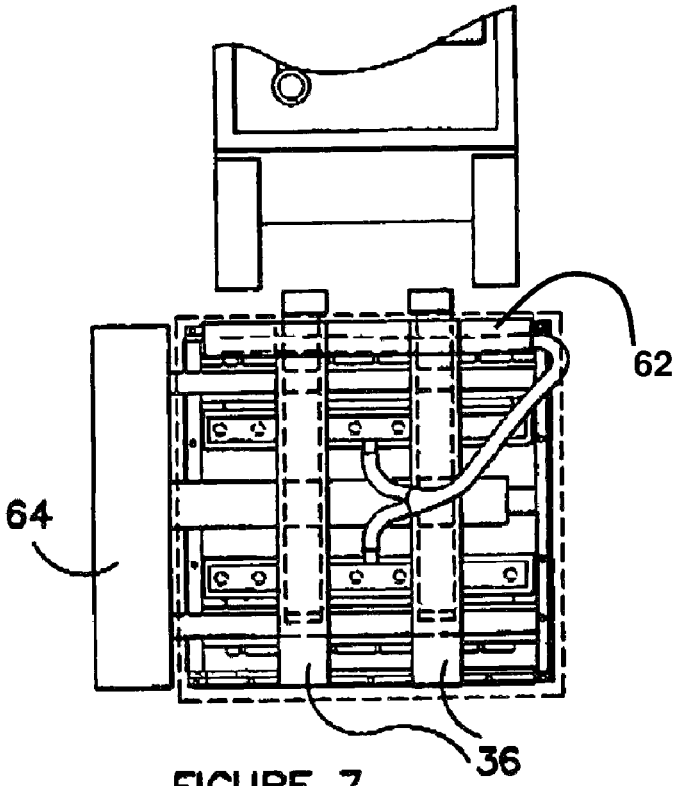
FIG. 7 is a plan of the head mounted on a sub assembly which permits the head to move to one side of the forklift.
Figure 8:
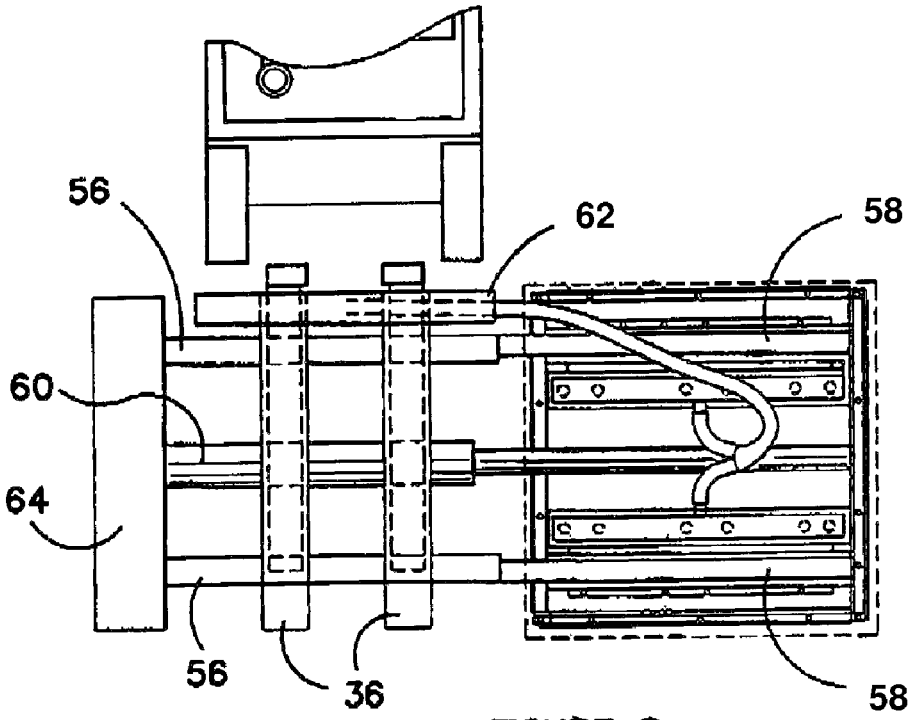
FIG. 8 is a plan of the head of FIG. 7 extended to the pick up/put down position.

Referring now to FIGS. 7 and 8, the shoes 36 support a pair of cross slides 56 which have rail extensions 58. The head is moved at 90° to the drive axis of the truck by a central ram 60. The hose pays out from a tubular guide 62 which takes it to the reel as in FIG. 1. Counterweight 64 balances the head.

In a non-illustrated version, the sub assembly has a radius arm instead of cross slides.

Figure 9:
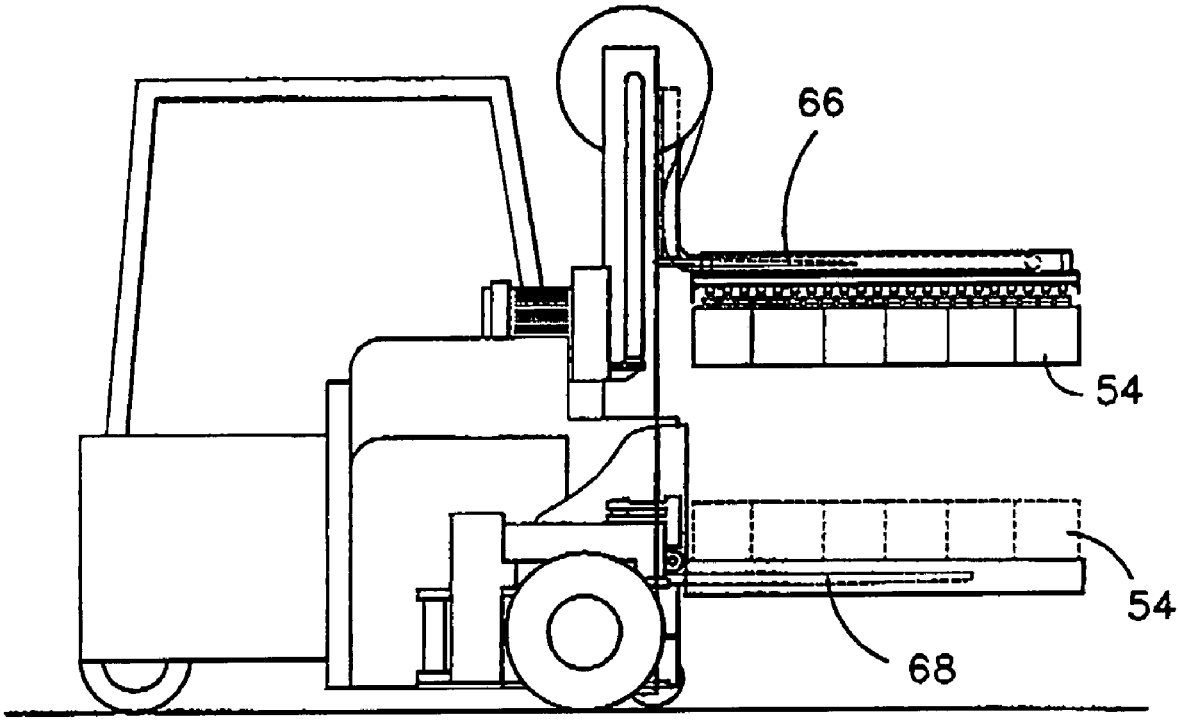
FIG. 9 shows a second embodiment with the pick up assembly carried by an electric reach truck, such trucks have the ability to move sideways along the 2900 mm wide aisles between warehouse stacks and reach into the stack.
Figure 10:
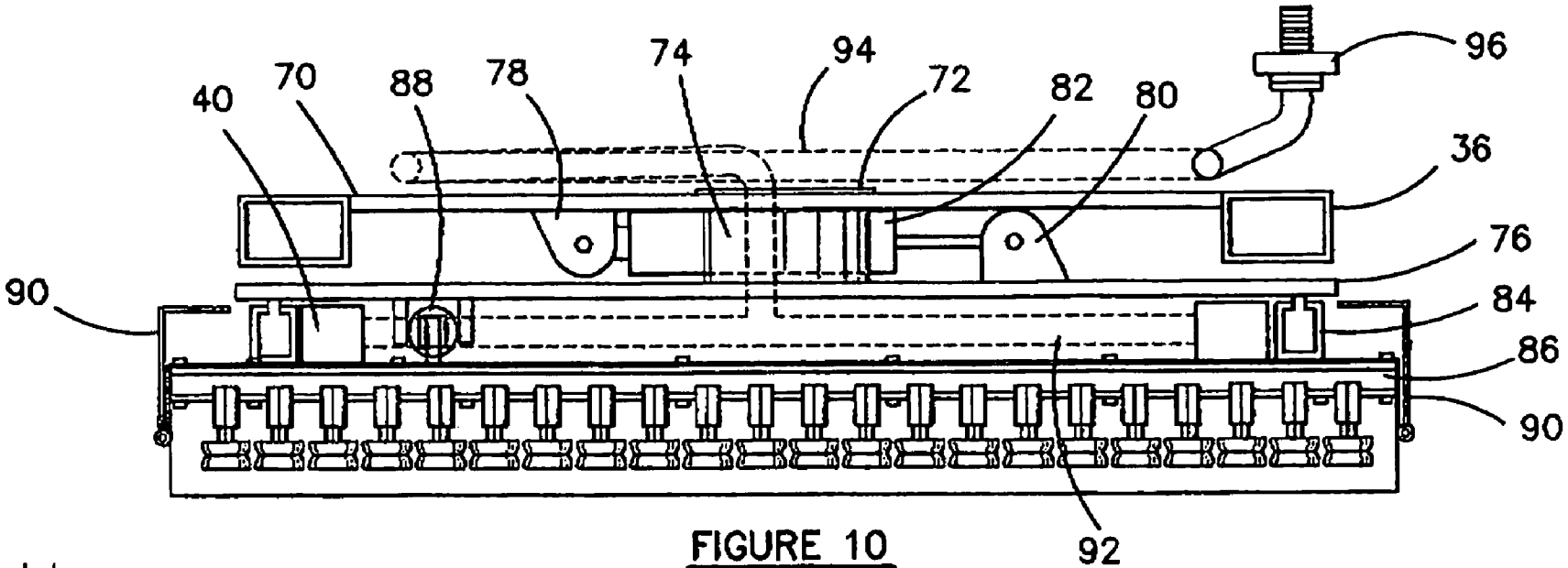
FIG. 10 is a front view of the head with slewing capability.
Figure 11:
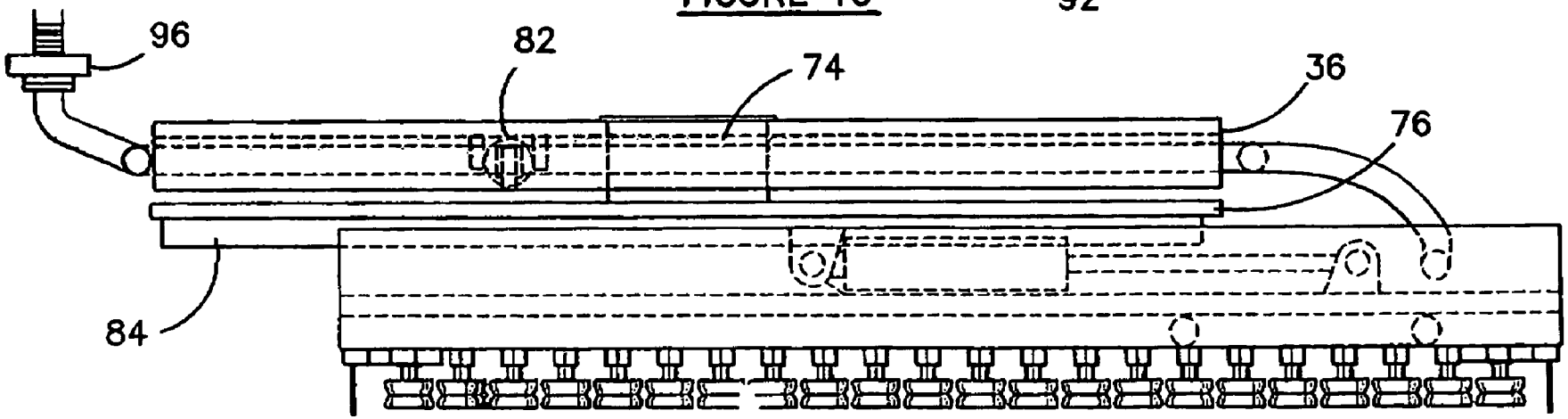
FIG. 11 is a side view of the head shown in FIG. 9.
Figure 12:
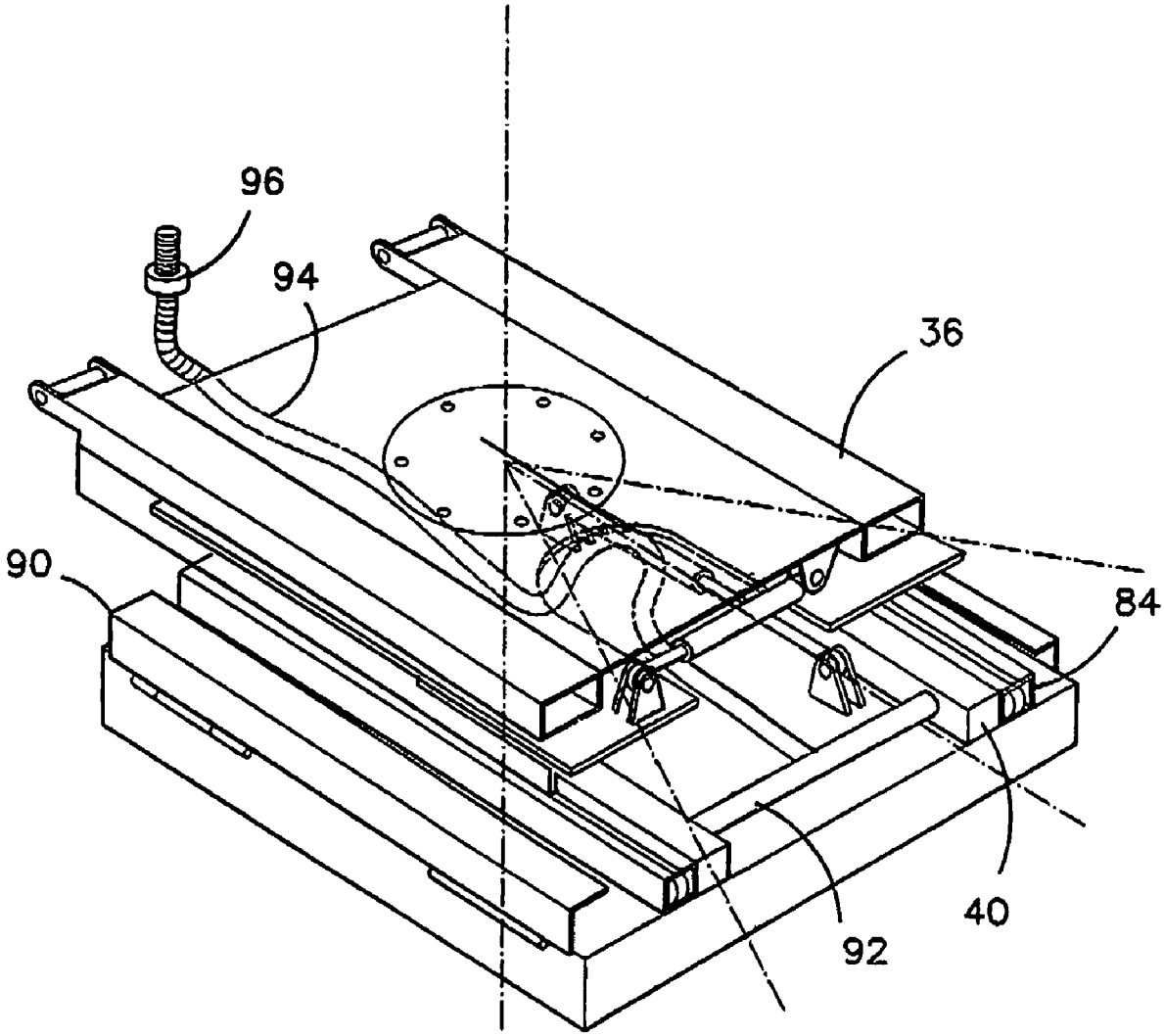
FIG. 12 is a perspective of the pick up assembly shown in FIG. 1.

In the second embodiment shown in FIG. 9, the pick up assembly is shown mounted on the forward facing forks 66. The truck has a second lower pair of forks 68 which underlie the pick up assembly. This arrangement permits a time-saving sequence in operation. The operator visits stack after stack making up the order on his list and after each pick up he fills the pallet waiting directly beneath. The filling pallet accompanies him until it is full when the driver takes the full pallet to the end of the aisle where a loading forklift collects it and takes it to a waiting truck or a loading point. The normal capacity of a human operator manually filling pallets is 130 cartons/hr. A reach truck with the pick up assembly of this invention can achieve four times the manual rate.

The stacks of cartons on warehouse or coolstore racks will have been unloaded by perhaps a different forklift or a different operator. The pallet stack which the reach truck builds must be orderly resembling a neat cube. The cubes are usually wrapped vertically with plastic sheet to prevent displacement during freighting. This means that the operator needs to be able to execute trimming movements when building a pallet. This version provides a reach facility which extends the fork advance by 300 mm and a slew facility which allows the operator to slew the pick up assembly by 15° on both sides of his advance axis.

In FIGS. 9, 10, 11 and 12, the shoes 36 are welded to top plate 70. Bearing disc 72 is bolted centrally to top plate 70. Bearing 74 is 240 mm in diameter and projects 75 mm below the top plate where it connects to rectangular turntable 76. Bracket 78 on the undersurface of the top plate and bracket 80 on the top surface of the turntable support a short stroke hydraulic ram 82. The ram allows the operator to make 15° LEFT or 15° RIGHT adjustments to the turntable. A pair of linear bearings 84 welded to the undersurface of the rectangular turntable near the edges thereof and to the top face of the vacuum chamber housing 86. The linear bearings are of standard type. For warehouse duty, the capacity need only be 250 kg. The reach facility provided by the bearing is 300 mm, but this allows useful fore and aft adjustment of the cartons position during pick up and release. Adjustment is possible by hydraulic ram 88 which acts between the underside of the turntable and the top face of the housing 86. The suction devices project below the housing. Fold down legs 90 made of L-section steel are hinged to mutually opposite sides of the housing 86 to take the weight of the assembly when it is necessary to park the assembly in the floor for transfer, exchange or maintenance. In use those suction devices which do not seal against part of the load will not allow air entry to reduce the vacuum. The internal ball in each unsealed device will rise and close off the device. The housing 86 is evacuated through flexible hoses 92. These join to feed flexible hose 94 which terminates in a KAMLOK™ union 96 fixed to the forks carriage of the forklift.

Figure 13:
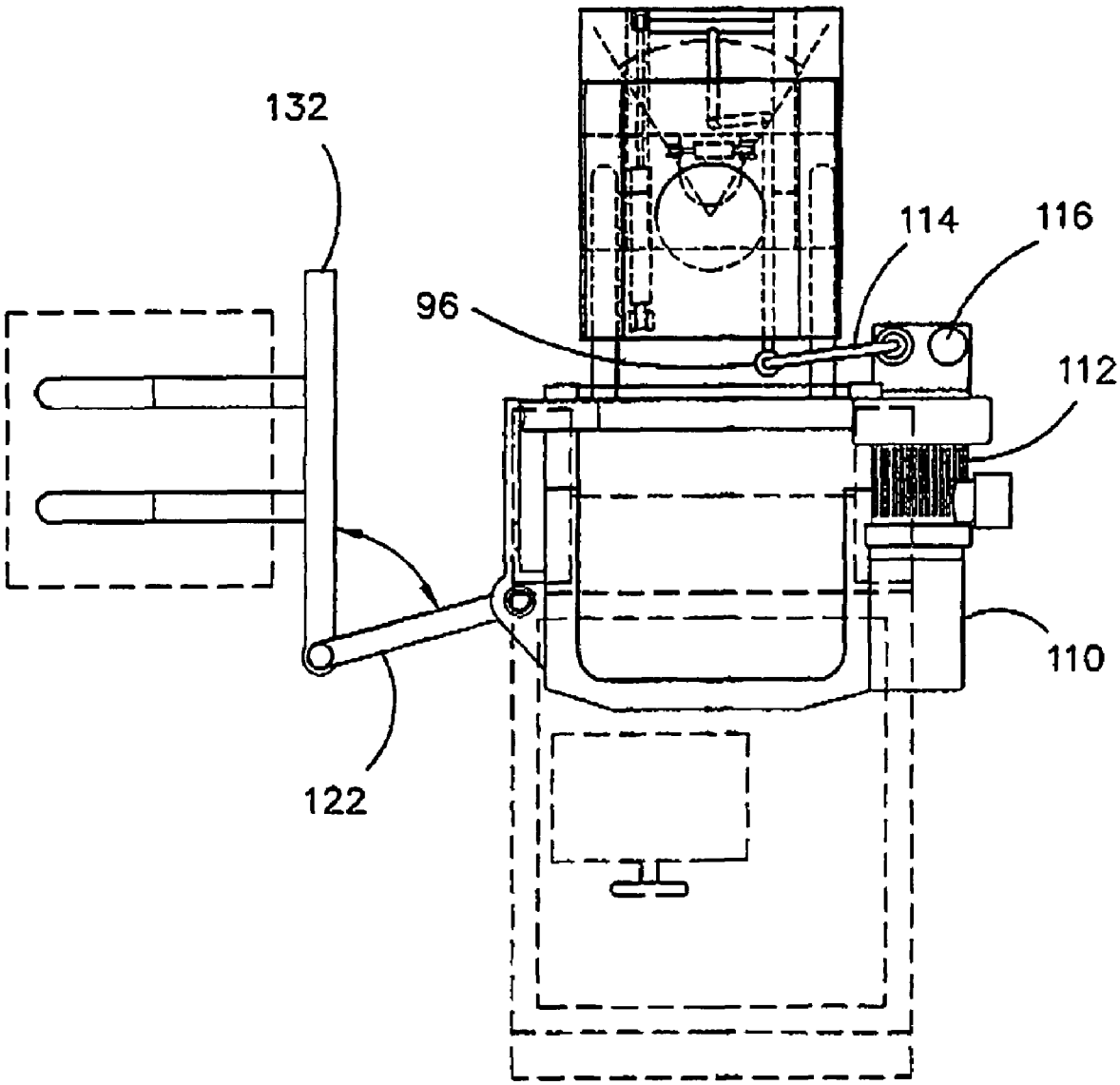
FIG. 13 is a plan of an electric reach truck with a slewing pallet feeder attached to the LHS.
Figure 14:
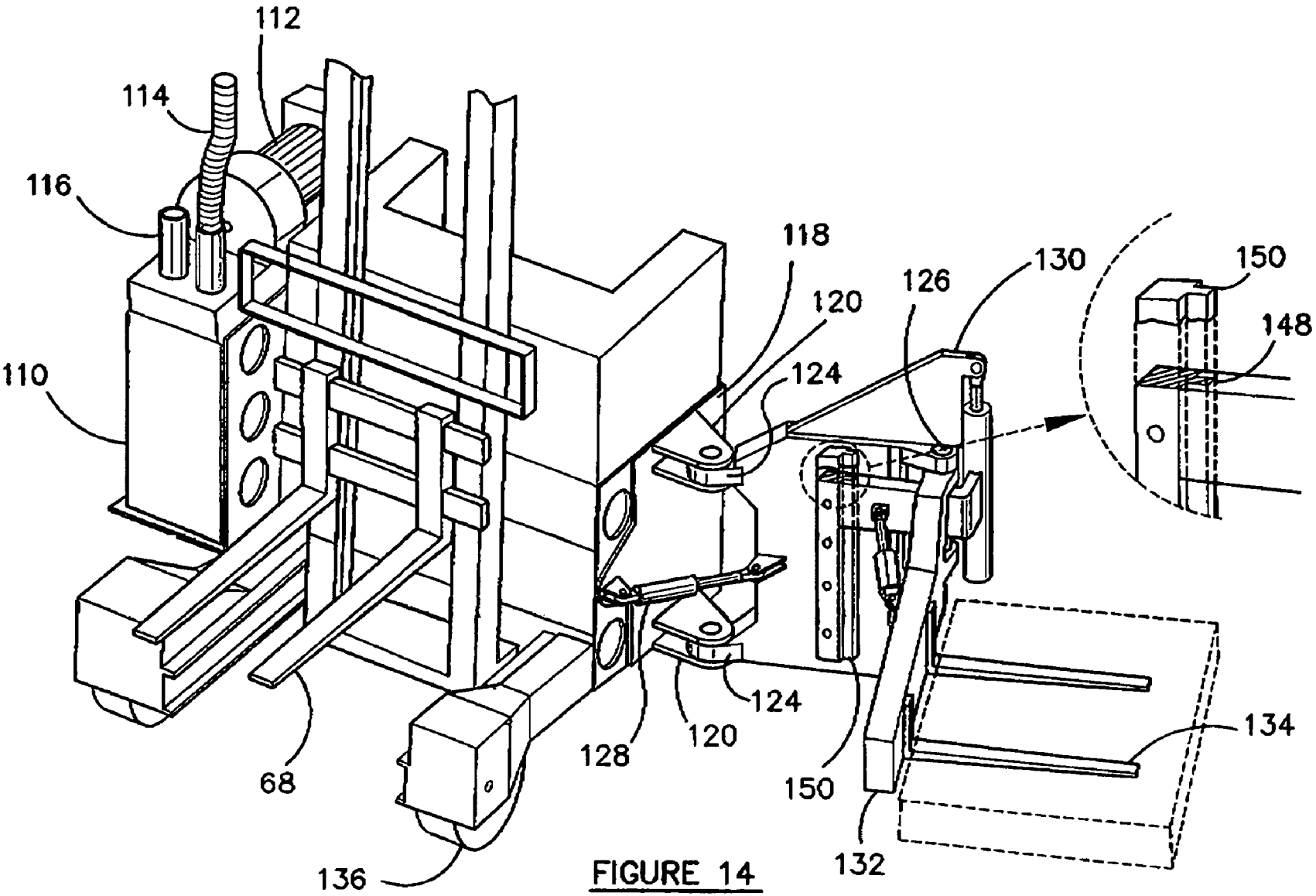
FIG. 14 is a perspective view of the pallet exchanging part of an electric reach truck.

In FIGS. 13 and 14, the right hand side of the truck has a compartment 110 which houses a 36 v dc forklift battery (not shown). This provides current for an electric blower 112 of 7.5 kw power rating. The blower is connected to the KAMLOK™ union 96 by a 75 mm plastic bellows hose 114 of the type used in swimming pool equipment. This keeps its shape under −0.37 bar which the blower generates. Air flow is 490 $m^3$/min. The blower is switched on and off as required by the driver as layers of cartons are lifted and released. The cardboard of the cartons is porous and tends to reduce the vacuum but the design of the suction devices provides sufficient lifting force for a 1200×1200 mm load. Exhaust air from the blower is directed upwardly through outlet 116.

Pallet Assembly

In FIG. 14 steel plate skirt 18 is bolted to the side of the truck. Two pairs of double hinge brackets 120 support upright steel swing frame 122. The swing frame has mounts 124 which support a 100 mm diameter swing post 126 and a swing ram 128 connected between the truck and the swing frame in order to move the frame in an arc. The swing frame has a suspension point 130 lying directly above pallet bar 132.

Figure 15:
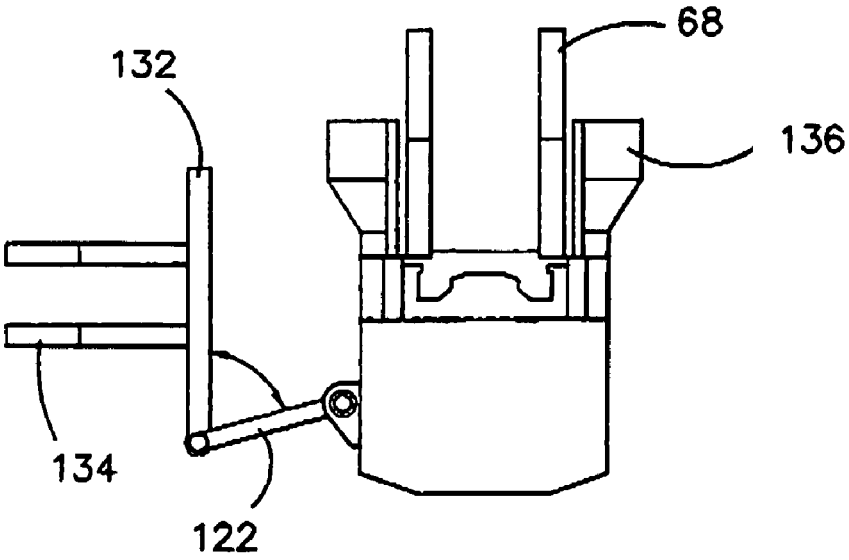
FIGS. 15-17 are plans of the electric reach truck showing how the pallet feeder cooperates with the pick up assembly.
Figure 16:
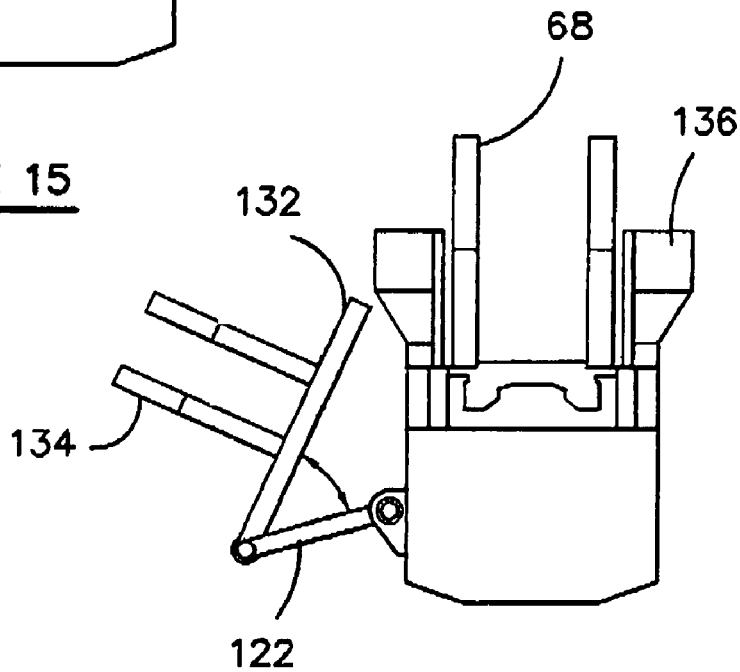
Figure 17:
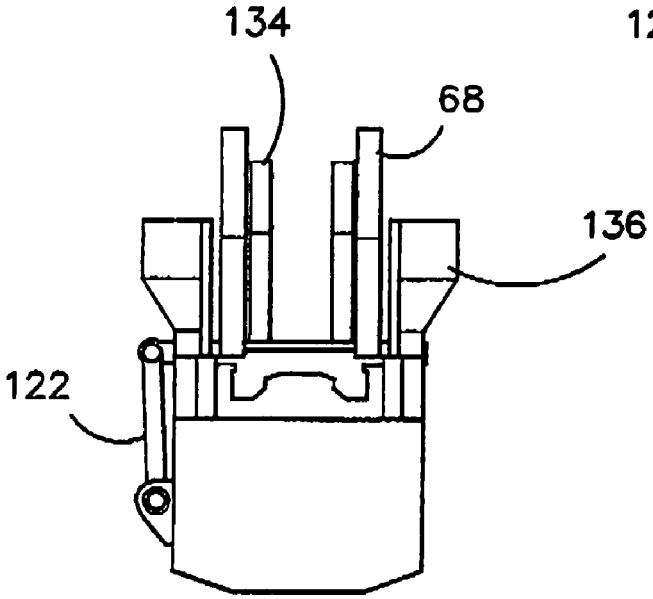
Figure 18:
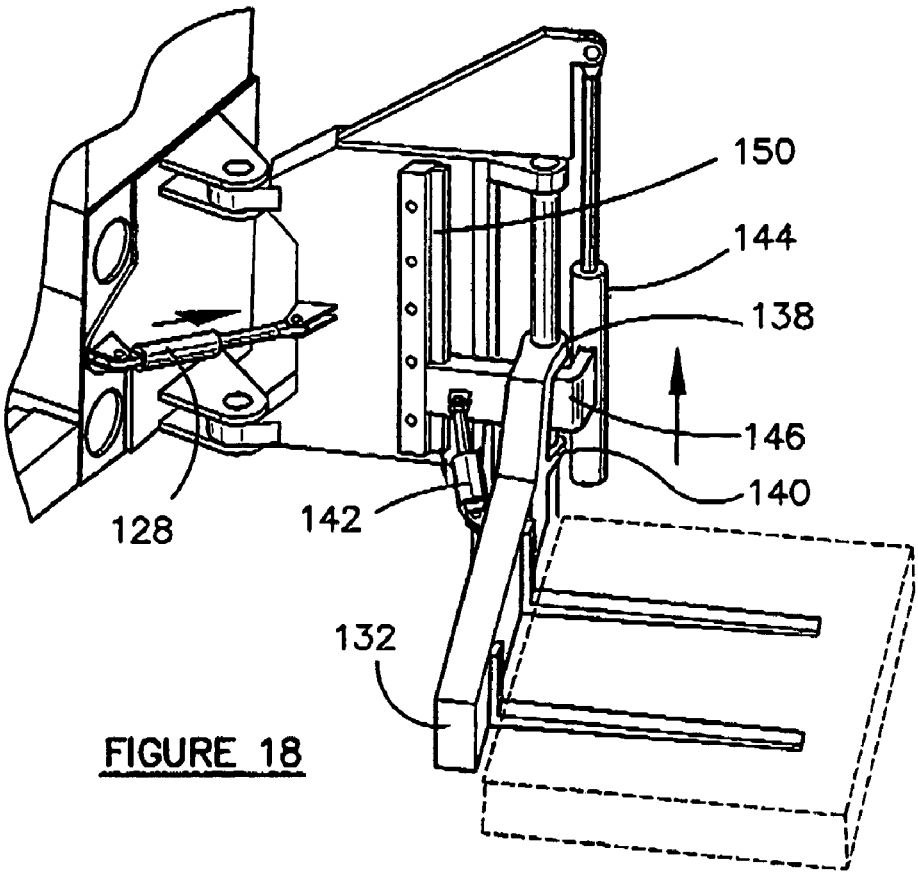
FIGS. 18 and 19 are both a detail of the pallet assembly showing the rise and fall of the pallet tines.

Pallet bar 132 is 1600 mm long and supports a pair of pallet tines 134. The tines pick up an empty pallet and the purpose of the pallet assembly is to raise the pallet so that it clears the truck wheels 136 and comes to rest directly beneath the pick up assembly. This sequence is shown in FIGS. 15-17.

Figure 19:
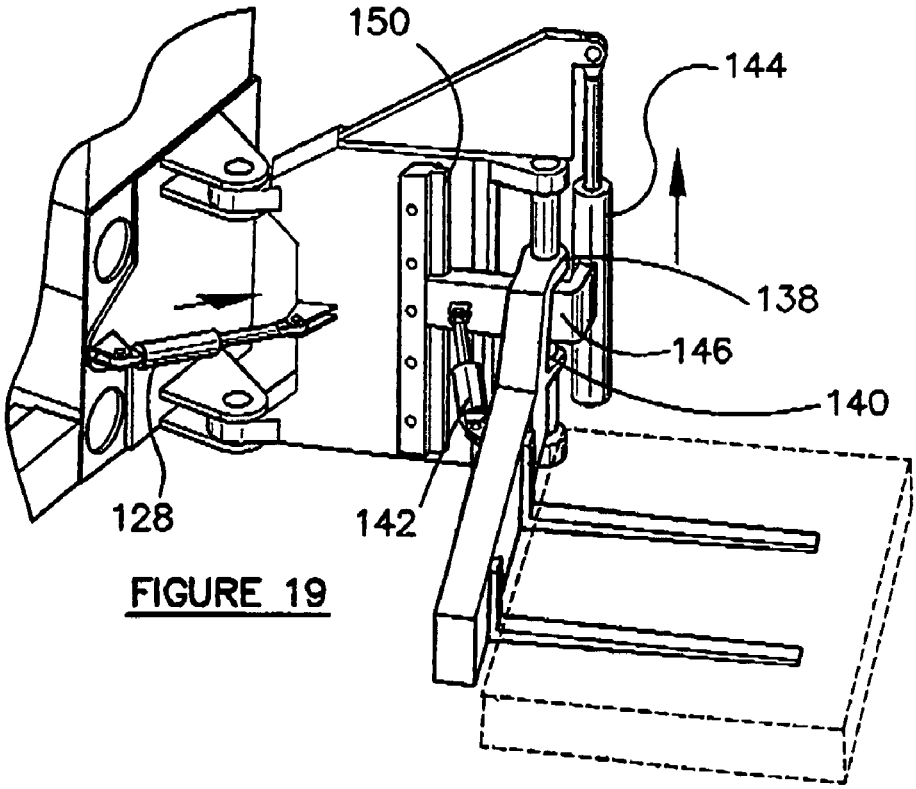

The pallet bar is L-shaped and has a pair of pivot arms 138, 140 (see FIG. 19). These engage the swing post and allow the bar to rise and fall in order to clear the truck wheel while still permitting the bar to swing and so execute the motion shown in FIG. 13. This requires the action of an extra swing ram 142 connected between the swing frame and the rear of the pallet bar. The rams 128 and 142 are supplied with hydraulic oil through a proportioning valve (not shown) which divides the thrust so that the arc described by the tines 134 is minimized for safe operation in the aisles of the warehouse. By causing ram 128 (FIG. 19) to move more than ram 142, the working space needed by the truck is reduced.

The pallet bar is raised and lowered by a ram 144 attached between the suspension point 130 and a lifter 146 which passes between the pivot arms 138, 140 and acts on upper arm 138. One end of the lifter 146 is connected to the ram 144 and the opposite end has a bifurcation 148 which rides up and down brass wear strip 150 which projects from the swing frame between top and bottom mounts 124. The lifter is bent around swing post 126. The lifter accordingly executes rectilinear motion while the pallet bar is free to swing within an operation arc shown in FIGS. 15-17. The mechanical load on the double hinge brackets 120 can be reduced by an optional wheel fixed beneath the swing frame.

I have found the advantages of the above embodiment to be:

1. Human handling of cartons is unnecessary with consequent savings in injury claims.

2. The proportion of partially filled pallets on road trucks can be reduced.

What is claimed is:

1. A pick up assembly for carriage by a forklift comprising a horizontal head with an array of suction devices projecting downwardly from the head having ends which lie substantially in a common plane so as to contact a load surface of a layer of goods or part thereof, a part in the head to connect the head to a vacuum source and means capable of detachably mounting the assembly on the lifting portion of a forklift, the head having a vacuum chamber common to the array and the chamber being connectable to a vacuum source on the forklift, wherein the suction devices each comprise a resilient bellows for sealing against the goods, a passage intermediate the bellows and the head providing flow connection between the bellows and the vacuum chamber, an upper valve seat in the passage, a lower valve seat in the passage, and a valve member in the passage capable of moving from one seat to the other such that contacting of the resilient bellows with the load surface of the goods and disengaging of the resilient bellows from the load surface of the goods being used to respectively lower and raise the valve member relative to the lower valve seat, and wherein the passage cross-section is greater than the valve member cross-section allowing the valve member to float between the upper and lower seats as air continues to flow around the valve member from the surface of the goods and into the passage when the bellows contact the goods and vacuum is being applied thereby maintaining partial vacuum in the passage for lifting and the valve member is adapted to rise to close against the upper valve seat when the bellows are not sealed against the goods thereby preventing air flow into the head.

2. A pick up assembly as claimed in claim 1, wherein the head has legs which are capable of supporting the suction devices clear of the ground when the head is out of service.

3. A pick up assembly as claimed in claim 1, wherein the head has means which is engageable and disengageable by the forks of the forklift.

4. A pick up assembly as claimed in claim 3, wherein the means is a pair of shoes into which the forks are slidable.

5. A pick up assembly as claimed in claim 1, wherein the horizontal area occupied by the head is substantially the same as that of a forklift pallet.

6. A pick up assembly as claimed in claim 1, wherein the means capable of mounting the assembly on the forklift includes a sub assembly capable of moving the head transversely of the fork direction in order to reach into racks lining an aisle.

7. A pick up assembly as claimed in claim 6, wherein extendable support means allow the head to move parallel to the ground between a retracted carrying position and an extended pick up/put down position and a ram moves the head between the two positions.

8. A pick up assembly as claimed in any claim 1, wherein the head has a connector for a radius arm mounted on the forklift to enable the assembly to swing through a vertical axis.

9. A forklift with an assembly as claimed in claim 1, wherein the head is connected by a hose to a self-rewinding hose reel for caffiage on the forklift.

10. A forklift bearing a pick up assembly as claimed in claim 1, wherein the head is connected by a hose to a vacuum source via a self-rewinding hose reel.

11. A pick up assembly as claimed in claim 1, wherein the valve member is a ball.

12. A pick up assembly for a forklift comprising a head with an away of downwardly directed suction devices, having ends which lie substantially in a common plane so as to contact an upper surface of a layer of goods or part thereof, means connectable to the head for generating a partial vacuum, and means for mounting the head on a forklift mast whereby the head is able to rise and fall, wherein the head has a vacuum chamber common to the away and the chamber is connectable to the means for generating the partial vacuum, the suction devices each comprise a resilient bellows for sealing against the goods, a passage intermediate the bellows and the head and providing flow connection between the bellows and the vacuum chamber, an upper valve seat in the passage, a lower valve seat in the passage, and a valve member in the passage capable of moving from one seat to the other such that contacting of the resilient bellows with the load surface of the goods and disengaging of the resilient bellows from the load surface of the goods being used to respectively lower and raise the valve member relative to the lower valve seat, and the passage cross-section is greater than the valve member cross-section allowing the valve member to float between the upper and lower seats as air continues to flow around the valve member from the surface of the goods and into the passage when the bellows contact the goods and vacuum is being applied and to rise to close against the upper valve seat when the bellows are not sealed against the goods thereby preventing air flow into the head.

13. A pick up assembly as claimed in claim 12, wherein the means for generating a partial vacuum is supported adjacent the forklift mast and is connected to the head by a flexible hose.

14. In a forklift the combination of a pick up assembly as claimed in claim 12 and a pallet fork assembly on a mount hinged to the forklift adjacent the mast, said assembly being capable of tilting on an upright hinge axis between a loading position beneath the pick up assembly and in register therewith and a staff/finish position lying substantially at 90° to the loading position.

15. In a forklift the combination of claim 14, wherein the pallet fork assembly has a ram connected between the forks and the mount in order to move the assembly between the staff/finish position in an arc of travel.

16. In a forklift the combination of claim 14, wherein the pallet fork assembly is connected to the forklift by a radial arm capable of supporting the pallet fork assembly in an arc of travel.

17. In a forklift the combination of claim 14 wherein the pallet fork assembly comprises a swing mount with a first hinge formation capable of connecting the mount to a side of the forklift and a second hinge formation capable of supporting the pallet forks of the assembly, a first ram connected between the swing mount and the side of the forklift and a second ram connected between the swing frame and the pallet fork.

18. In a forklift the combination of claim 17 wherein the second hinge formation includes an upright swing post, the pallet forks slidingly engage the swing post and a lift ram connected between the swing mount and the pallet forks raises and lowers the pallet forks.

19. In a forklift the combination of claim 18 wherein a lifter is interposed between the pallet forks and ram and the lifter has an end connected to the lift ram and an opposite end which engages a slide fixed to the swing mount whereby the lifter performs rectilinear motion while allowing the pallet to describe an arc.

20. A pick up assembly as claimed in claim 12, wherein the valve member is a ball.

21. A four direction forklift having a pick up assembly comprising a head with an array of downwardly directed suction devices, having ends which lie substantially in a common plane so as to contact an upper surface of a layer of goods or part thereof, means connectable to the head for generating a partial vacuum, and means for mounting the head on a forklift mast whereby the head is able to rise and fall, and wherein the means for generating a partial vacuum is supported adjacent the forklift mast and is connected to the head by a flexible hose, wherein the head has a vacuum chamber common to the array and the chamber is connectable to the means for generating a partial vacuum, the suction devices each comprise a resilient bellows for sealing against the goods, a passage intermediate the bellows and the head and providing flow connection between the bellows and the vacuum chamber, an upper valve seat in the passage, a lower valve seat in the passage, and a valve member in the passage capable of moving from one seat to the other such that contacting of the resilient bellows with the load surface of the goods and disengaging of the resilient bellows from the load surface of the goods being used to respectively lower and raise the valve member relative to the lower valve seat, and wherein the passage cross-section is greater than the valve member cross-section allowing the valve member to float between the upper and lower seats as air continues to flow around the valve member from the surface of the goods and into the passage when the bellows contact when the bellows seal to the goods and vacuum is being applied and to rise to close against the upper valve seat when the bellows are not sealed against the goods thereby preventing air flow into the head.

22. A pick up assembly as claimed in claim 21, wherein the valve member is a ball.

23. A four direction forklift having a pick up assembly comprising a head with an array of downwardly directed suction devices, having ends which lie substantially in a common plane so as to contact an upper surface of a layer of goods or part thereof, means connectable to the head for generating a partial vacuum, and means for detachably mounting the head on a forklift mast whereby the head is able to rise and fall, and a pallet fork assembly on a mount hinged to the forklift adjacent the mast, said assembly being capable of tilting on an upright hinge axis between a loading position beneath the pick up assembly and in register therewith and a start/finish position lying substantially at 90° to the loading position, wherein the pallet fork assembly comprises a swing mount with a first hinge formation capable of connecting the mount to a side of the forklift and a second hinge formation capable of supporting the pallet forks of the assembly, a first ram connected between the swing mount and the side of the forklift and a second ram connected between the swing frame and the pallet forks, and wherein the pick up assembly further comprises a part in the head to connect the head to the means for generating a partial vacuum, the head having a vacuum chamber common to the array and the chamber being connectable to the means for generating a partial vacuum, wherein the suction devices each comprise a resilient bellows for sealing against the goods, a passage intermediate the bellows and the head providing flow connection between the bellows and the vacuum chamber, an upper valve seat in the passage, a lower valve seat in the passage, and a valve member in the passage capable of moving from one seat to the other such that contacting of the resilient bellows with the load surface of the goods and disengaging of the resilient bellows from the load surface of the goods being used to respectively lower and raise the valve member relative to the lower valve seat, and wherein the passage cross-section is greater than the valve member cross-section allowing the valve member to float between the upper and lower seats as air continues to flow around the valve member from the surface of the goods and into the passage when the bellows contact the goods and vacuum is being applied thereby maintaining partial vacuum in the passage for lifting and the valve member is adapted to rise to close against the upper valve seat when the bellows are not sealed against the goods thereby preventing air flow into the head.

24. A method of assembling a warehouse order with a forklift or reach truck, the method comprising the steps of:

engaging a pallet layer of goods or part thereof by applying a partial vacuum between gang lifting means and the goods from substantially above the goods where the gang lifting means is detachably mounted to the lifting portion of the forklift or reach truck and capable of overlying a pallet layer of goods;

wherein the step of engaging comprises:

engaging the goods located within the layer with a plurality of suction devices formed within an array where the away substantially covers the layer, wherein the suction devices each comprise a resilient bellows for contact against the goods;

lowering the gang lifting means so as to displace only those suction devices that contact any goods within the layer and causing the devices that are in contact with the goods to open and make connection to the partial vacuum such that contacting of the resilient bellows with the load surface of the goods and disengaging of the resilient bellows from the load surface of the goods is used to respectively lower and raise the valve member relative to the lower valve seat in each suction device;

maintaining the suction devices as closed when not in contact with goods;

allowing a valve member in each displaced suction device to float as air from the surface of the goods continues to flow around the valve member under the partial vacuum, between lower and upper valve seats located in a passage intermediate the bellows of the displaced suction device and the head.

25. A method as claimed in claim 24 further comprising the step of transferring the engaged goods forming at least a partial pallet layer to a pallet or from a pallet.

26. A method as claimed in claim 24, wherein the step of maintaining each suction device as closed comprises the valve member rising to close against the upper valve seat under the partial vacuum when the suction device is not in contact with goods thereby preventing air flow into the gang lifting means.

27. A method as claimed in claim 24, wherein the valve member is a ball.

* * * * *